US005211419A

United States Patent [19]

Gorliez et al.

[11] Patent Number: 5,211,419

[45] Date of Patent: May 18, 1993

[54] SKI BINDING AND MEANS AND METHOD FOR ATTACHMENT TO SKI

[75] Inventors: Jean-Philippe Gorliez, Aix les Bains; Gilles R. Goud, Annecy, both of France

[73] Assignee: Salomon S.A., Annecy, France

[21] Appl. No.: 571,494

[22] Filed: Aug. 22, 1990

[30] Foreign Application Priority Data

Aug. 22, 1989 [FR] France ..... 89 11121

[51] Int. Cl.[5] ..... A63C 9/22

[52] U.S. Cl. ..... 280/633; 280/611; 280/623

[58] Field of Search ..... 280/633, 611, 11.31, 280/623, 636

[56] References Cited

U.S. PATENT DOCUMENTS

| | | | |
|---|---|---|---|
| 2,664,294 | 12/1953 | Kleinman | 280/11.27 |
| 3,219,359 | 11/1965 | Schneider | 280/11.35 |
| 3,917,300 | 11/1975 | Salomon | 280/11.35 R |
| 3,977,688 | 8/1976 | Imagawa | 280/633 |
| 3,993,318 | 11/1976 | Rothmayer | 280/11.26 |
| 4,158,377 | 6/1979 | Beyl | 151/69 |
| 4,268,062 | 5/1981 | Wittmann | 280/611 |
| 4,524,990 | 6/1985 | Svoboda et al. | 280/633 |
| 4,640,524 | 2/1987 | Sedlmair | 280/611 |

FOREIGN PATENT DOCUMENTS

| | | |
|---|---|---|
| 0983543 | 2/1976 | Canada . |
| 2102757 | 7/1971 | Fed. Rep. of Germany . |
| 2363662 | 8/1974 | Fed. Rep. of Germany . |
| 2922269 | 1/1980 | Fed. Rep. of Germany . |
| 1352777 | 5/1964 | France . |
| 2208692 | 6/1974 | France . |
| 2286667 | 4/1976 | France . |
| 2431868 | 2/1980 | France . |
| 2632201 | 12/1989 | France . |

*Primary Examiner*—Eric D. Culbreth

*Attorney, Agent, or Firm*—Sandler, Greenblum & Bernstein

[57] ABSTRACT

A ski binding apparatus and method for facilitating the mounting of a ski binding onto a ski. The ski binding apparatus of the invention includes a body which carries a jaw for retention of a ski boot and a base affixed to the lower portion of the body. The base has holes for receiving screws for mounting the binding to the ski. Further, the base has a lower surface, a frontal surface, and a longitudinal groove formed in the lower surface. The longitudinal groove extends to and opens into the lower surface and the frontal surface of the base. A retention element is slidably received within the groove and extends therefrom in a transport and preassembly position of the binding apparatus. A fastener is held in the retention element in the extended position such that, when the binding is mounted upon the ski, the fastener secures the retention element to the ski, after which the binding is slid forwardly, receiving the retention element within the groove and, thereafter, additional fasteners complete the attachment of the binding to the ski.

41 Claims, 5 Drawing Sheets

SKI BINDING AND MEANS AND METHOD FOR ATTACHMENT TO SKI

BACKGROUND OF THE INVENTION

1. Field of the Invention

The present invention relates to a release binding for a ski and a means and a method for attaching the binding to a ski.

2. Description of Background and Other Information

Presently known safety bindings for skis which are adapted to maintain the front of a boot (toe bindings) or the rear of the boot (heel bindings), generally include a body or housing on which a jaw is mounted for retention of the boot, this body being solidly affixed, at its lower part, to a base by which the safety binding is mounted on the ski. The mounting of the body of the binding is achieved by means of screws which go through holes bored in the base and which are screwed into the upper surface of the ski.

For the mounting of certain safety bindings, and particularly front bindings, a "hidden" screw is frequently utilized, i.e., a screw which is not accessible once the binding is mounted on the ski. The "hidden" screw is screwed into the ski before the binding is secured in its final position. It is a shouldered screw having a head with a large diameter extended by a body with an intermediate diameter, and a threaded rod with a small diameter. Once it is thoroughly screwed into the ski, the head of the screw is maintained at a height determined with respect to the surface of the ski, this height corresponding to that of the body of the screw.

This "hidden" screw cooperates with a slot in the shape of a buttonhole which is formed in the lower surface of the base of the binding. The slot includes two parts, namely a circular part with a diameter greater than that of the screw head so as to permit the passage of the head through it, and a longitudinal slit opening into the circular part and having a width equal to the diameter of the screw body.

The mounting of a safety binding maintained by such a "hidden" screw requires a certain number of operations. In the first place, the person who mounts the binding, after having opened the packing box for the binding, must find in the box the "hidden" screw which, because of its cooperation with the buttonhole-shaped slot, has a certain configuration. After that, the operator must thoroughly screw this screw into a front hole provided for this purpose in the upper surface of the ski. Then he or she must take hold of the binding, apply it flat on the ski and displace it, feeling his or her way, until he or she is able to make the circular opening of the buttonhole-shaped slot correspond with the head of the "hidden" screw. At this moment he or she presses on the binding so as to engage the head of the "hidden" screw in the circular opening of the buttonhole and he or she then slides the binding longitudinally so that the body with an intermediate diameter which is provided under the screw head engages in the longitudinal slit of the slot. The operator then completes the mounting of the binding by the screwing of other screws provided for this purpose.

If such a method of mounting is preferable because the "hidden" screw does not require any particular arrangement in the upper part of the binding, it still has the disadvantage that the hidden screw must be individually set apart in the packing box for the binding to be screwed to the ski. Moreover, this screw can be lost, which poses a particular problem, given the particular configuration that the "hidden" screw has in order to be able to cooperate with the buttonhole-shaped slot.

Furthermore, there are known safety bindings which are provided with means for maintaining the fixation screws in place in their respective holes provided in the base. Such a binding is described, for example, in French Patent Application No. 2,208,692.

SUMMARY OF THE INVENTION

It is therefore an object of the present invention to provide a binding apparatus for a ski including a body, the body carrying a jaw for retention of a boot; a base affixed to the lower portion of the body, the base having holes for receiving screws for mounting the binding to the ski, the base also having a lower surface, a frontal surface, and a longitudinal groove formed in the lower surface, the longitudinal groove extending to and opening into the lower surface and the frontal surface of the base, the longitudinal groove having a slot which extends to the lower surface and a channel larger than the slot, one of the screws being a hidden screw located within the groove in a mounted position of the binding apparatus upon the ski; and a small bar slidably mounted and partially engagable within the longitudinal groove in a transport position of the binding apparatus, i.e., in a mounting position of the binding apparatus, the small bar and the groove having generally complementary transverse cross-sections for preventing substantial movement of the small bar in a direction perpendicular to the lower surface of the base, the small bar having a hole within which the hidden screw is maintained, exteriorly of the base, in the transport position of the binding apparatus.

Preferably, the hole of the small bar has a diameter only slightly smaller than that of the hidden screw.

Further, the small bar has a lower surface, and, in the transport position, the hidden screw has a point which point protrudes slightly beneath the lower side of the small bar.

According to a particular aspect of the invention, the small bar has a lower part which has a width which is generally equal to the width of the slot of the longitudinal groove, the channel of the longitudinal groove has a width larger than the width of the slot. The small bar has an upper part tightly engaged in the channel of the longitudinal groove.

In a particular embodiment of the invention, the channel of the longitudinal groove and the upper part of the small bar have respective transverse cross-sections in the shape of an isosceles trapezoid, a small lower base of which the width is equal to the width of the slot of the longitudinal groove and of which the lower part of the small bar, the small bar and the groove constituting a dovetail assembly.

Further according to the preferred embodiment of the invention, the small bar and the longitudinal groove have flat lateral sides.

Still further according to the preferred embodiment of the invention, the small bar and the longitudinal groove each has a respective rounded end.

In a particular aspect of a preferred embodiment, the small bar has an inner end, a lower surface, and a centering pin projecting downwardly from the lower surface, the centering pin being located between the inner end of the small bar and the hole for the hidden screw.

According to another aspect of a particular embodiment of the invention, the small bar has an inner end, a lower part with lateral vertical sides and a pair of laterally opposed recesses located between the inner end of the small bar and the hole for the hidden screw, the slot of the longitudinal groove has a pair of lateral walls and a pair of laterally opposed elastic lips extending from the lateral walls of the slot inwardly of the groove for forming a ratchet relationship with the laterally opposed recesses of the lower part of the small bar.

Alternatively, the small bar can be provided with projections and the groove can be provided with cooperating recesses.

Still further according to a particular embodiment of the invention, the small bar has a lower part with lateral vertical sides has a pair of laterally opposed projections, the slot of the longitudinal groove has a pair of lateral walls with a pair of laterally opposed recesses cooperating with the pair of laterally opposed projections of the small bar for maintaining the small bar, either in an extended position in relation to the base, or in an engaged position in the longitudinal groove of the base In a further embodiment of the invention, the lower part and the upper part of the small bar have a junction which is inclined from top to bottom towards the front of the base, and the slot and the channel of the longitudinal groove have a junction has an incline equal to the junction of the lower part and the upper part of the small bar.

In a still further embodiment of the invention, the small bar and the longitudinal groove have a shape, in plan view, which converges from front to rear.

In a particular aspect of an embodiment of the invention, the small bar has a front surface, a lower rear surface and a bevelled lower surface extending from the lower rear surface to the front surface, the bevelled surface being positioned between the hole for the hidden screw and the front surface of the small bar. Further, the base has a front lower bevelled surface which coincides with bevelled surface of the small bar.

In a still further embodiment of the invention, the longitudinal groove and the small bar have respective rear ends in which the length of the small bar is slightly less than that of the longitudinal groove so that a slight gap exists between the rear end of the small bar and the rear end of the longitudinal groove when the small bar is completely positioned within the longitudinal groove of the base.

It is a further object of the present invention to provide a ski binding apparatus including a base for engagement with the upper surface of a ski and for receiving means for attaching the base to the ski, the base having a lower surface and an end surface, the base further having a longitudinally extending groove which opens in the lower surface and the end surface, and a retention element for engagement within the longitudinally extending groove of the base for retaining a fastener outside of the base prior to assembly of the base upon the ski, and for retaining the base upon the ski after assembly of the base upon the ski, the retention element including means for facilitating the fastening of the fastener to the ski.

The lower surface of the base includes a forward lower surface and a rearward lower surface, the forward lower surface and the rearward lower surface being connected at a transverse edge, whereby the forward lower surface and the rearward lower surface form an angle at the transverse edge of slightly more than 180°.

It is a still further object of the invention to provide a retention assembly for securing a ski binding upon a ski including a fastener and a retention element for engagement within a longitudinally extending groove of a base of the ski binding, the retention element having a hole within which the fastener is positioned and retained by the retention element outside of the base prior to assembly of the base upon the ski, the retention element including means for retaining the base upon the ski after assembly of the base upon the ski and for facilitating the fastening of the fastener to the ski.

It is a still further object of the invention to provide a method of assembling a ski binding to a ski, the ski binding having a base with a longitudinally extending groove opening in a lower surface and an end surface of the base, a retention element retaining a threaded fastener therein, the retention element extending from the end surface, the method including the steps of (a) placing the ski binding, with the retention element extending from the end surface, upon the ski at a first predetermined location on the ski; (b) screwing the threaded fastener into the ski, thereby securing the threaded fastener to the ski; (c) displacing the ski binding longitudinally toward the retention element for receiving the retention element within the longitudinally extending groove; (d) stopping longitudinal displacement of the ski binding at a second predetermined location With the retention element being retained in the longitudinally extending groove to thereby fasten a first portion of the ski binding onto the ski; and (e) fastening a second portion of the ski binding onto the ski.

Further, the method of the invention includes providing a hole in the ski for receiving the threaded fastener, whereby the first predetermined location at which the ski binding is placed is determined such that the threaded fastener and the hole are substantially vertically aligned.

Further, the step of fastening a second portion of the ski binding onto the ski includes screwing a plurality of additional threaded fasteners through the base and into the ski.

Still further, the method includes the step of providing a plurality of holes in the ski for receiving respective ones of the additional threaded fasteners, whereby the second predetermined location at which longitudinal displacement of the ski binding is stopped is determined such that the additional threaded fasteners and their respective holes are substantially vertically aligned.

Still further, the step of placing the ski binding upon the ski at a first predetermined location on the ski includes locating a locating pin, extending from a lower surface of the retention element into a pilot hole in the ski provide a method and a means for facilitating the mounting of a ski binding onto a ski.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

The present invention has, as an objective, the facilitation of the mounting of a binding of the "hidden" screw type on a ski and to provide an improved binding of this type.

The present invention concerns improvements in the releasable binding held on the ski by a "hidden" screw and with the objective of considerably facilitating the mounting operation of the binding on the ski.

To this end, the present invention includes a ski binding having a body or housing on which a jaw is mounted for retention of the boot and which is solidly affixed, at its lower part, to a base. The base is mounted on the ski by means of screws of which certain ones go through holes located in the base and of which one constitutes, after mounting, a screw which is engaged in a lower longitudinal groove which is formed in the lower surface of the base into which it opens. The groove in the base of the binding has an enlarged portion within the base of the binding, communicating with a slot in the lower portion of the base of the binding. The lower longitudinal groove of the base opens into the front of the base which is situated opposite the binding jaw. Within the groove a small bar is partially engaged, longitudinally slidable therein. The bar projects beyond the front of the base, the small bar and the groove having transverse sections of respectively complementary shapes, preventing any disengagement of the small bar outside of the groove in the vertical direction, that is, perpendicular to the lower side of the base. Thereby, the screw to be hidden is positioned, during transport and mounting of the binding, in a vertical hole provided in the external part of the small bar projecting from the outside of the base.

The binding according to the invention offers the advantage that after screwing the base of the binding onto the ski, it is the assembly of the small bar carrying the "hidden" screw which constitutes an interface between the ski and the binding frame. The entire periphery of the small bar in contact with the base is used for stress transmission. As a result, stress is distributed on a larger surface than in the case where retention of the binding frame is ensured by a screw head engaged directly in the bottom of a groove.

Figure 1:
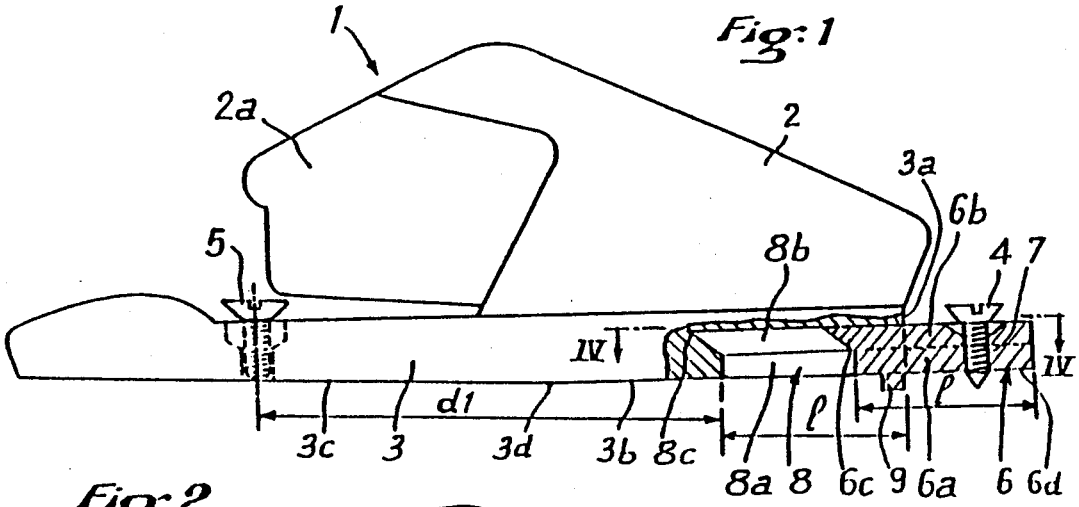
FIG. 1 is an elevation view, partially in vertical and longitudinal cross-section, of the front binding according to the invention.

The releasable binding, which is designated in its entirety by the reference numeral 1 in FIG. 1, is intended to hold the front of a boot on a ski. It contains a front binding element with, on its upper part, a body 2 to which a movable retention jaw 2*a* is provided in the rear, and a lower part, a base 3 intended to be mounted on a ski by means of a screw. The upper body 2 of the front binding element can form a single unit with the base 3 or the body can be separate from the base, with a lengthwise sliding connection.

The base 3 contains a forward facing side 3*a* which is situated opposite the retention jaw 2*a*. The lower side of the base is not flat but has a forward part 3*b* and a rear part 3*c* inclined towards each other, forming a dihedral open towards the top and an adjacent obtuse angle of slightly less than 180°. The front part 3*b* and rear part 3*c* are connected by a transverse edge 3*d*, constituting the edge of the dihedral.

The mounting of the front binding element 1 is ensured by means of a front screw 4 intended to be a "hidden" screw and at least one back screw 5. For this purpose, the front binding 1 is delivered, in its packing case, with the front screw and back screws 5 held in place, as represented in FIG. 1.

The back screws 5 are held in the holes in the base 3 by malleable retention devices of any appropriate type, as is described in French Patent Application 2,208,692, for example.

Figure 2:
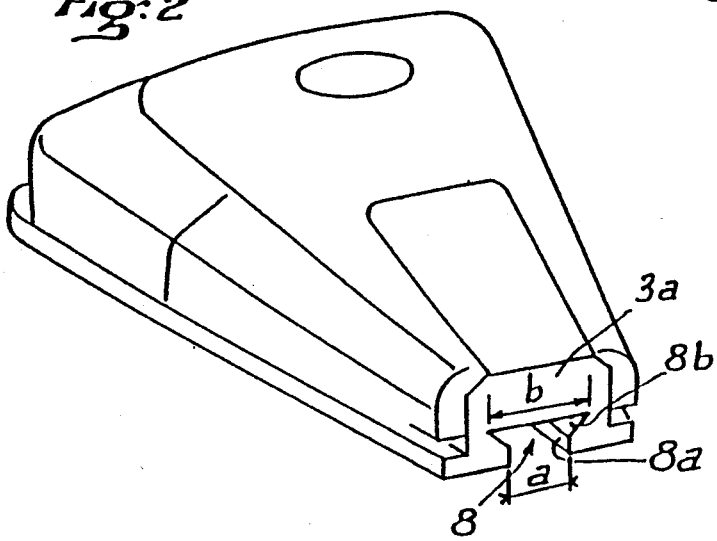
FIG. 2 is a view in perspective, from the front and below, of the front binding of FIG. 1 without the small bar carrying the "hidden" screw.
Figure 4:
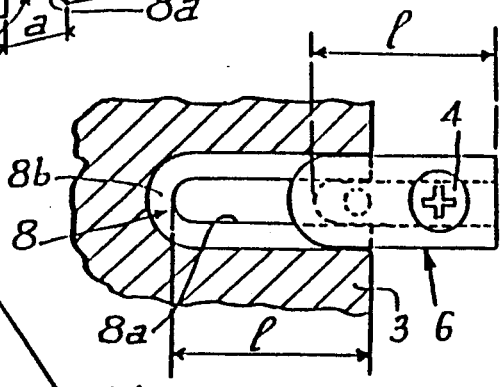
FIG. 4 is a horizontal cross-sectional view, taken along line IV—IV of FIG. 1.
Figure 3:
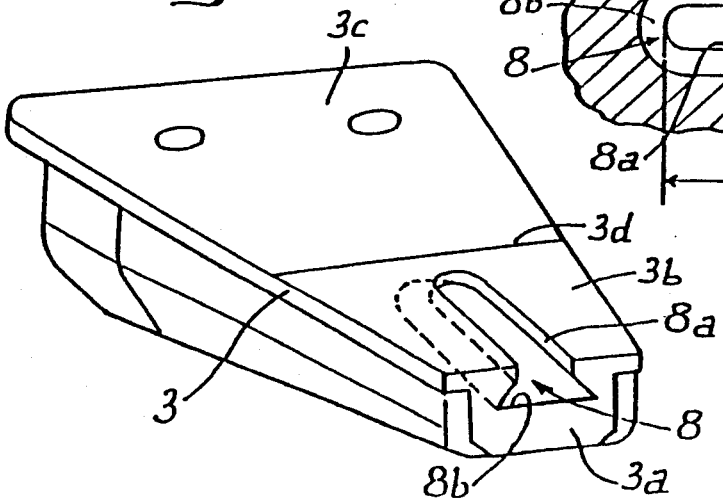
FIG. 3 is a perspective view of the front binding of FIG. 1, without the small bar, turned upside down.
Figure 5:
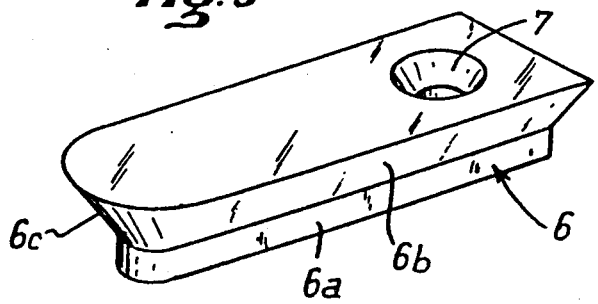
FIG. 5 is a perspective view of the small bar holding the "hidden" screw.
Figure 6:
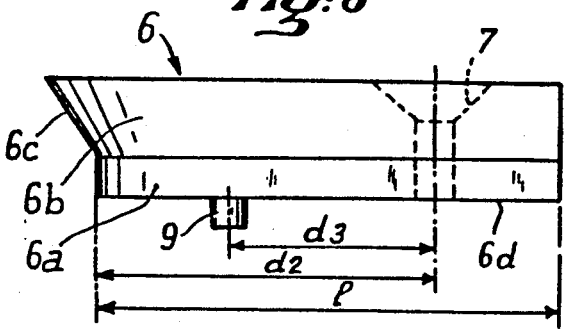
FIG. 6 is a side elevation view of the small bar holding the "hidden" screw.
Figure 7:
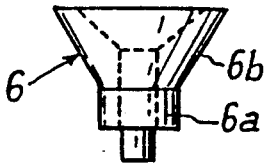
FIG. 7 is an end elevation view of the inner end of the small bar.

The front screw 4 is held in front of base 3 by a small holding bar 6 with a vertical hole 7 in which the screw 4 is engaged and held, preferably with its point slightly projecting under the lower side of the bar 6. The small bar thereby performs the function of retaining the hidden screw prior to assembly of the binding element to the ski. For this purpose, the hole 7 has a diameter only slightly less than that of the screw 4. The small holding bar 6, preferably made from a plastic material, is slidingly engaged lengthwise in a longitudinal groove 8, recessed in the lower forward port 3*b* of the base 3 which ends in the forward side 3*a* of the base 3, as is seen more easily in FIGS. 2 and 3.

The small bar 6 and the groove 8 are preferably of the same length l and their respective transverse sections are of complementary shape which prevent any disengagement of the small bar 6 outside of the groove 8 in the vertical direction, that is, perpendicular to the lower side of the base 3. This groove 8 includes a lower lengthwise slot 8*a* of a width equal to the width of the lower part 6*a* of the small bar 6 and of which the internal or rear end is located at a distance d1 from the axes of the holes in which the rear screws 5 are held. In addition, the internal or rear end of the lower part 6*a* of small bar 6 is located at a distance d2 from the axis of hole 7 receiving the front screw 4. Above the lower lengthwise slot 8*a* extends a recess or upper lengthwise channel 8*b* of width b larger than the width a of the lower lengthwise slot 8*a*.

In the recess or upper channel 8*b* , which can have any appropriate form of transverse section, is engaged the upper part 6*b* of the small bar 6, which has the same transverse section. In the non-limiting constructional form represented in the drawing, this transverse section has the shape of an isosceles trapezoid with a small lower base of which the width is equal to that of the slot 8*a*. The form of the small bar 6 and the groove 8 constitute, at their upper part, a dovetail assembly. However, any other transverse section could be provided for the channel 8*b* of the groove 8, particularly rectangular (in which the transverse section of the groove 8 has the form of a T), circular, etc.

The internal or rear ends of the small bar 6 holding the "hidden" screw 4, and of the groove 8 of the base 3 can terminate in flat transverse sides. According to a particularly advantageous form of the invention, the internal or rear end 6*c* of the small bar 6, and 8*c* of the groove 8, can have a rounded convex shape turned towards the rear, as seen in the drawing.

Preferably, the small bar 6 contains, on its lower horizontal side 6*d*, a centering pin 9 projecting downwardly, between the internal or rear end 6*c* and the hole 7 at a distance d3 from the axis of the hole 7.

With respect to FIGS. 8–11, the successive operations which occur in the mounting of the front binding element 1 on the upper surface of ski 11 will now be described. Ski 11 is preferably pierced by the pilot, or lead, holes 11*a* and 11*b* into which the screws 4 and 5 are screwed to lock the front stop 1. The axis of the front lead hole 11*a*, which receives the hidden screw 4, is pierced at a distance x from the axis of the rear lead holes 11*b* which receive the rear screw 5; distance x equals the sum of the distance d1 extending between the internal or rear end of the lower slot 8*a* of groove 8 and the axis of each hole in the base 3 receiving a rear screw 5, and the distance d2 between the axis of hole 7 of the small bar 6 receiving the "hidden" screw 4 and the internal or rear end of the lower part 6*a* of the small bar 6. A blind hole 11*c* is also provided in the upper surface of the ski, positioned at a distance d3 behind hole 11*a*, aligned with the latter on the longitudinal axis of the ski.

Figure 8:
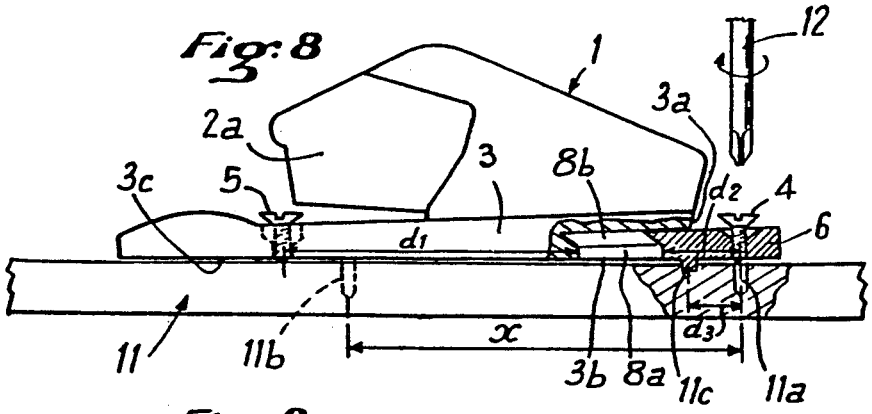
FIGS. 8-11 are elevation views, in partial vertical and longitudinal cross-section, illustrating the different phases of the mounting operation of the front binding on the ski.

Once the front stop is a removed from its packing case, it is placed on a ski so that its base 3 is applied flat to the upper side of the ski 11 with respect to its rear surface 3*c*. As a result, its forward surface 3*b* and, consequently, the small bar 6, are slightly inclined from the bottom to top and from back to front as illustrated in FIG. 8. The front stop 1 is then brought into a position where the centering pin 9 is engaged in the blind hole 11*c* and, as a result, the front screw 4 held by the small bar 6 in front of the forward side 3*a* of base 3, is placed just above the hole 11*a* intended to receive it, the small bar 6 always remaining slightly raised. In this position, the point of screw 4, projecting under the lower side of the small bar 6, may already be slightly engaged in the entrance of the lead hole 11*a*.

Figure 9:
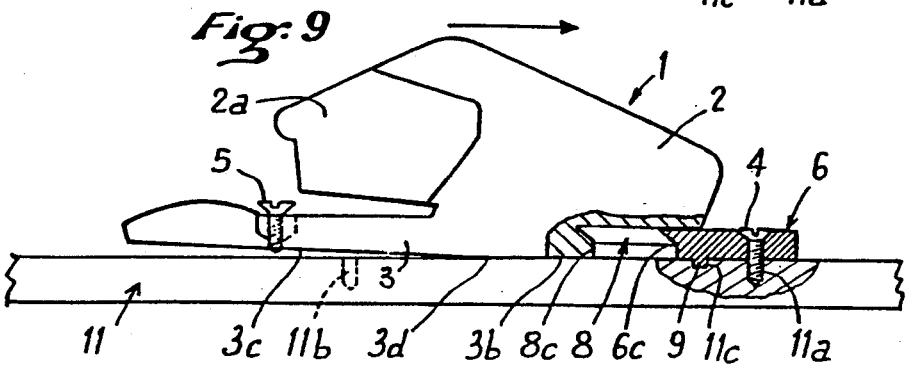

The second phase of the mounting operation consists of screwing the screw 4 in the lead hole 11*a* with an appropriate tool such as a screwdriver 12. During the screwing, the small bar 6 is gradually applied to the upper surface of the ski 11, in alignment with the longitudinal axis of the ski, ending by being firmly locked on this surface, as seen in FIG. 9. This occurs by a slight forward tilting of the assembly of the binding 1 around the edge 3*d* of the dihedral formed by the lower surfaces 3*b*, 3*c* of the base 3, and in elevation of the rear part of the base 3.

Figure 10:
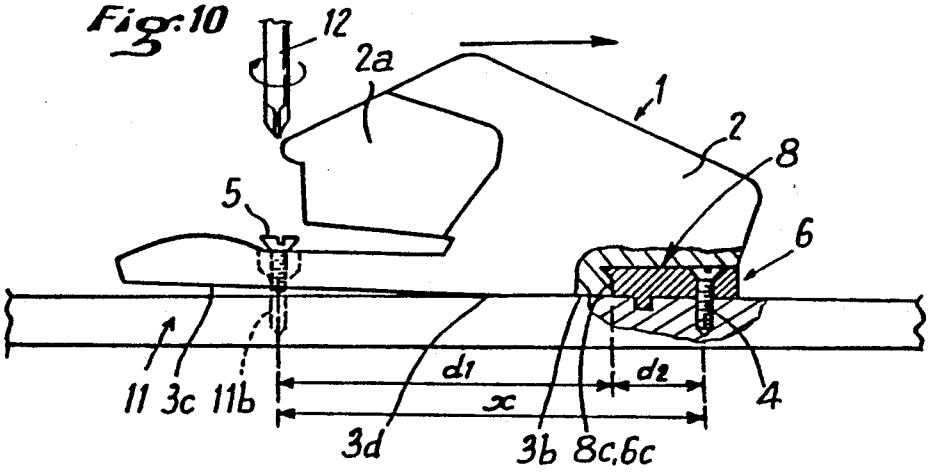
Figure 11:
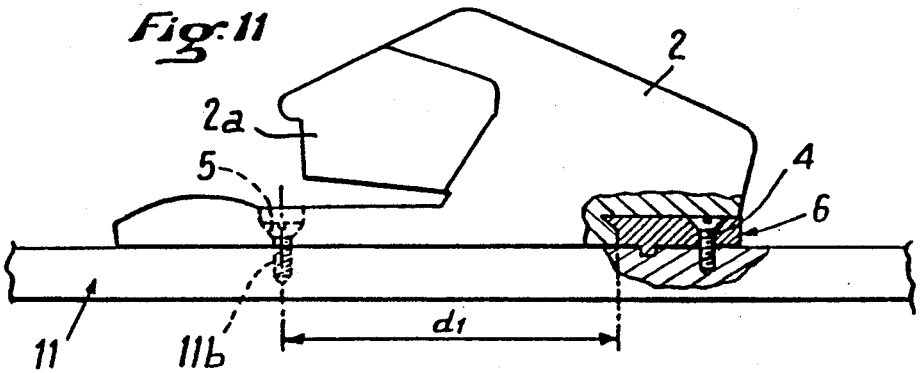

The third phase of the mounting operation of the front stop 1 consists, as illustrated in FIG. 10, of moving the stop 1 towards the front. The effect of this shift is that the lengthwise groove 8 slides tightly on the small bar 6 attached to the ski and constitutes a lengthwise guiding mechanism. This forward movement continues until the rear or internal end 8*c* of the groove 8 of the base 3 comes into contact with the rear or internal end 6*c* of the small bar 6. In this position, the front screw 4 is completely "hidden" under the base 3, and the rear screws 5 are then situated just above the corresponding lead holes 11*b* in the upper side of the ski 11, because of the equivalence of the distances x and d1+d2, as indicated in FIG. 10.

The last phase of the mounting operation consists of screwing the rear screws 5 in their lead holes 11*b* with a screwdriver 12. The screwing of the rear screws 5 creates a tilting of the rear part of the front binding element 1 towards the ski, which eliminates the vertical play between the upper part 6*b* of the small bar 6 and the upper channel 8*b* of the groove 8. Because of the tilting movement of the binding element around the edge 3*d* of the dihedral 3*b*, 3*c*, the inclined sides of the upper channel 8*b* of the groove 8 are applied with great pressure under the inclined sides of the upper part 6*b* of the small bar 6, which ensures the firm maintenance of the front stop along the entire length of the small bar 6.

Figure 14:
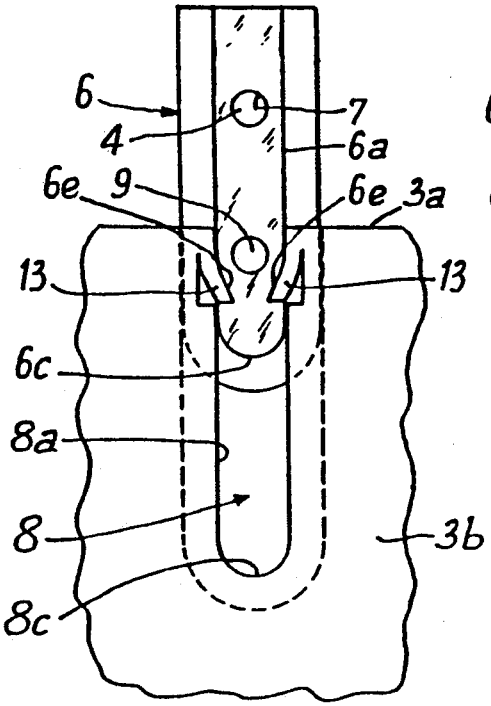
FIG. 14 is a view from below of the small bar in FIGS. 12 and 13 partially engaged in the lower groove of the binding.
Figure 12:
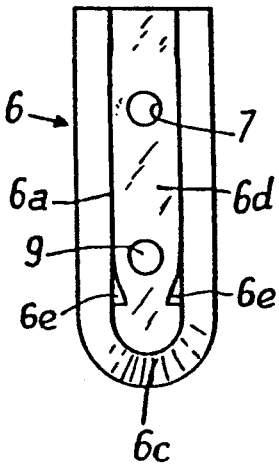
FIG. 12 is a view from below of a variation of the fabrication of the small bar holding the "hidden" screw.
Figure 13:
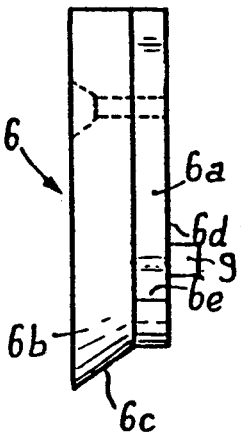
FIG. 13 is a side elevation view of the small bar in FIG. 12.

In the variation represented in FIGS. 12, 13, and 14, the lateral vertical sides of the lower part 6*a* of the small bar 6 are hollowed with a pair of screw recesses or notches 6*e*, situated between the internal or rear end 6*c* of the small bar 6 and the hole 7 for the "hidden" screw 4. In these screw notches 6*e* are engaged two opposing elastic lips, or dovetail keys, 13, forming a ratchet connection, the lips being contiguous with the lateral walls of the lower slot 8*a* of the groove 8. The lips 13 are notched and arched to form a projection in relation to the lateral walls of the groove 8, directed towards the interior of the latter. In the transport position, as represented in FIG. 14, the dovetail keys 13 are elastically engaged in the two screw notches 6*e*, thus constituting a tight holding connection containing the small bar 6 in its extended position. In this extended position, the small bar 6 is prevented from any outward movement by the elastic keys 13 forming stop catches against the notches 6*e*. In the other direction, towards the interior of the base 3, the small bar 6 is held by the front screw 4 which, abutting against the forward side 3*a* of the base 3, prevents movement of the small bar 6 into the groove 8. During the mounting of the front binding element on the ski, when the body of the binding element is pushed forward after screwing the forward or "hidden" screw 4, the elastic keys 13 are pushed back towards the outside and slide the length of the lateral vertical sides of the lower part 6a of the small bar 6.

Figure 15:
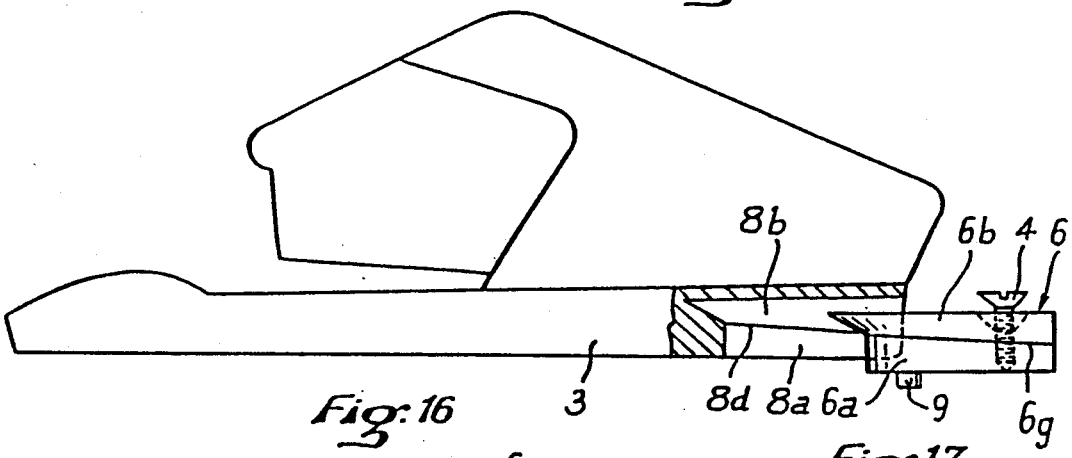
FIG. 15 is an elevation view, in partial vertical and longitudinal cross-section, of a front binding including a variation in the construction of the small bar holding the "hidden" screw partially engaged in the receiving groove.

In the variation illustrated in FIG. 15, the junction 6g between the lower right part 6a and the upper part 6b, forming a dovetail with the small bar 6, is inclined from top to bottom and from back to front, in the direction of the forward side 3a and, likewise for the junction 8d between the lower right slot 8a and the dovetail upper channel 8b of the groove 8, the inclination of the two junctions 16 and 8d being the same. When the small bar 6 is in the extended position, as in FIG. 15, there is a slight vertical play towards the bottom between the small bar 6 and the base 3. On the other hand, this play disappears completely when the base 3 is totally engaged on the small bar 6.

Figure 16:
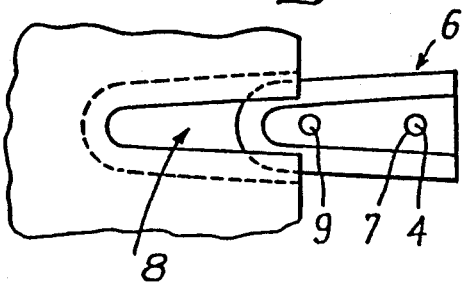
FIG. 16 is a view from below of a variation of a fabrication of the forward part of the front binding in which the small bar holding the "hidden" screw is retained.

In the variation illustrated in FIG. 16, the small bar 6 and the groove 8 present, in a plan view, a shape converging towards the rear of the binding. As a result, there is a slight transverse horizontal play when the small bar 6 is in the extended position, as is seen in FIG. 16.

The devices illustrated in FIGS. 15 and 16 can be used in combination, which permits both a vertical play and a transverse horizontal play when the bar is in the extended position.

Figure 17:
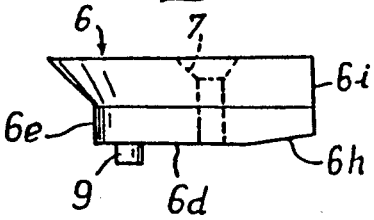
FIG. 17 is an elevation view of a variation on the fabrication of the small bar holding the "hidden" screw.
Figure 18:
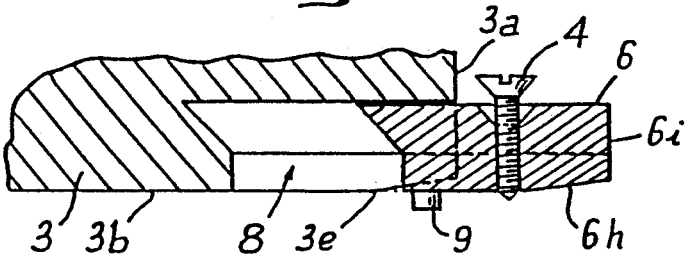
FIGS. 18 and 19 are partial vertical longitudinal cross-sections of the front of the front binding containing the small bar of FIG. 17, before and after the screwing of the "hidden" screw and the ski, respectively.
Figure 19:
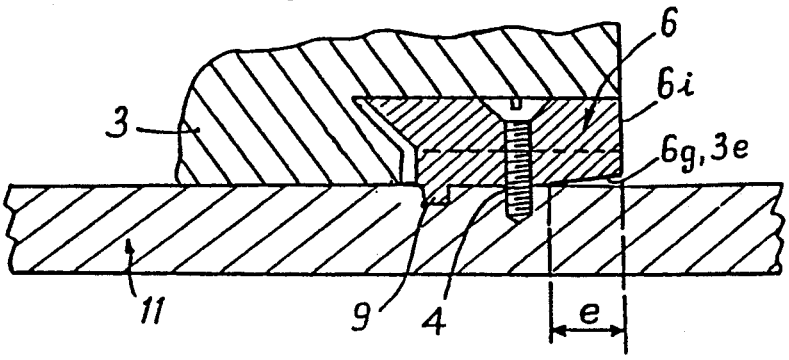

In the variation of the construction represented in FIGS. 17, 18 and 19, the small bar 6 has on its lower side a bevel 6h extending between the lower horizontal side 6d of small bar 6 in its external frontal side 6i. The lower beveled side 6h is formed in the area between the hole 7 and the external frontal side 6i. In the same way, the bevelled inclined side 3e is designed in the front of the lower side 3b of the base 3, this inclined bevelled side 3e extending between the lower side 3b and the frontal side 3a. As a consequence, when the base 3 is completely engaged on the small bar 6, as represented in FIG. 19, the two lower bevelled inclined sides 6g and 3e define a free space in the zone e where the ski can bend. As a result, the ski can bend from its spatula almost to the point where the front "hidden" screw 4 is engaged.

Preferably, the small bar 6 is slightly shorter than the groove 8 so that when the base 3 is completely engaged on the small bar 6, as illustrated in FIG. 19, a slight play exists between the rear end 6c of the small bar 6 and the rear end 8c of the groove 8. As a result, when the ski bends, a slight sliding is possible between the small bar 6 and the base 3, which diminishes the obstruction to bending of the ski caused by the presence of the binding 1.

Figure 21:
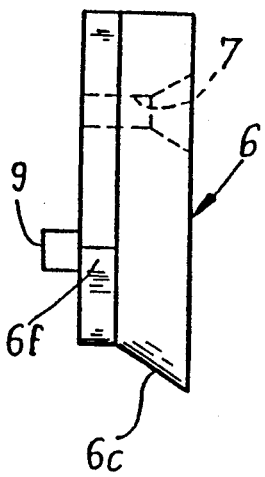
FIG. 21 is an elevation view of the small bar in FIG. 20.
Figure 20:
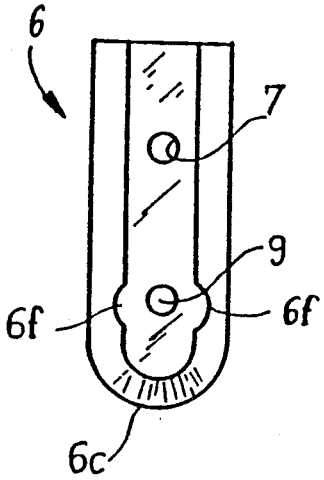
FIG. 20 is a view from below of another variation on the fabrication of a small bar holding the "hidden" screw.
Figure 22:
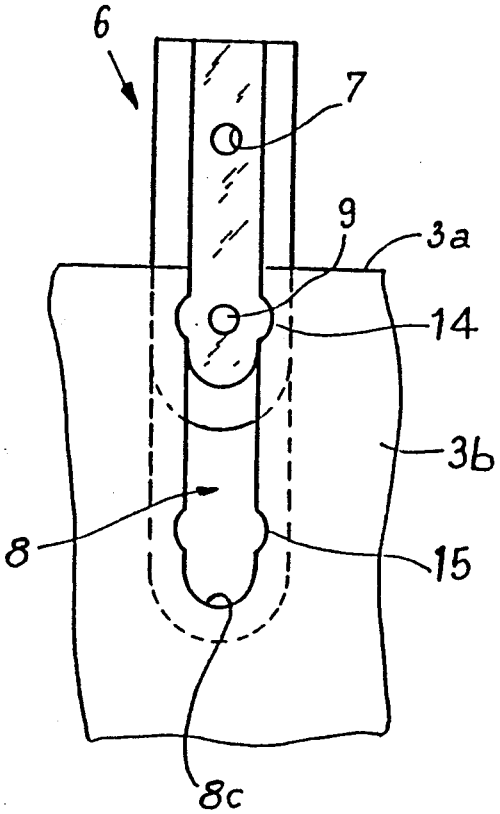
FIG. 22 is a view from below of the small bar in FIGS. 20 and 21, partially engaged in the lower groove of the binding.

In the variation of construction represented in FIGS. 20, 21 and 22, the lateral vertical sides of the lower part 6a of the small bar 6 have opposing enlargements or projections 6f, which are formed near the rear end 6c of the small bar 6. These projections 6f are designed to engage in two pairs of opposed recessed 14 and 15 which are formed in the lateral walls of the lower slot 8a of the groove 8. The first pair of recesses 14 is located near the forward side 3a of the base 3, while the second pair of recesses 15 is near the rear end 8c of groove 8. In the transport position, illustrated in FIG. 22, the two projections 6f of the small bar 6 are engaged respectively in the two housings 14 near the frontal wall 3a, thus constituting a tight connection holding the small bar 6 in its extended position. During the mounting of the front binding element on the ski, when the body of the binding element is pushed forwardly, after screwing in the front or "hidden" screw 4, the lateral walls of the lower slot 8a of the groove 8 elastically yield and are pushed slightly outwardly, which permits the base 3 to slide lengthwise on the small bar 6, until the projections 6f are engaged in the second pair of housings 15 near the rear end 8c of the groove 8.

The device described above could be reversed, that is, the lateral vertical sides of the lower part 6a of the small bar 6 could be hollowed with two housings instead of the projections 6f, the lateral walls of the lower slot 8a of the groove 8 then having, instead of the recesses 14 and 15, pairs of corresponding projections which engage in the recesses provided in the small bar 6.

Finally, although the invention has been described with reference of particular means, materials and embodiments, it is to be understood that the invention is not limited to the particulars disclosed and extends to all equivalents within the scope of the claims.

What is claimed is:

1. A binding apparatus for a ski comprising:

(a) a body, said body carrying a jaw for retardation of a boot, said body having a lower portion;

(b) a base affixed to said lower portion of said body, and at least a first screw for attaching said base to the ski, said base having at least one hole for receiving said first screw for mounting said binding to the ski, said base having a lower surface and a frontal surface, said base further comprising a longitudinal groove formed in said lower surface, said longitudinal groove extending to and opening into said lower surface and said frontal surface of said base, said longitudinal groove having a slot which extends to said lower surface and a channel being larger than said slot; and (c) a small bar slidably mounted and partially engagable and maintained within said longitudinal groove in a transport position of said binding apparatus and a further screw for mounting said small bar to the ski, said small bar and said groove having generally complementary transverse cross-sections for preventing substantial movement of said small bar in a direction perpendicular to said lower surface of said base, said small bar having a hole within which said further screw is maintained, exteriorly of said base, in said transport position of said binding apparatus, said further screw comprising a hidden screw, being hidden within said groove in a mounted position of said binding apparatus upon the ski, said first screw being spaced from said small bar.

2. A binding apparatus according to claim 1, said hole of said small bar having a diameter only slightly smaller than that of said hidden screw.

3. A binding apparatus according to claim 1, said small bar having a lower surface, and, in said transport position, said hidden screw having a point which point protrudes slightly beneath the lower side of the small bar.

4. A binding apparatus according to claim 1, said small bar having a lower part which has a width which is generally equal to the width of said slot of said longitudinal groove, said channel of said longitudinal groove having a width larger than the width of said slot, said small bar having an upper part tightly engaged in said channel of said longitudinal groove.

5. A binding apparatus according to claim 4, said channel of said longitudinal groove, and said upper part of said small bar having a transverse cross-section in the shape of an isosceles trapezoid, with a small lower base of which the width is equal to the width of said slot of said longitudinal groove and of which said lower part of said small bar, said small bar and said groove constituting a dovetail assembly.

6. A binding apparatus according to claim 1, said small bar and said longitudinal groove having flat lateral sides.

7. A binding apparatus according to claim 1, said small bar and said longitudinal groove each having a respective rounded end.

8. A binding apparatus according to claim 1, said small bar having an inner end, a lower surface, and a centering pin projecting downwardly from said lower surface, said centering pin being located between said inner end of said small bar and said hole for said hidden screw.

9. A binding apparatus according to claim 1, said small bar having an inner end, a lower part with lateral vertical sides and a pair of laterally opposed recesses located between said inner end of said small bar and said hole for said hidden screw, said slot of said longitudinal groove having a pair of lateral walls and a pair of laterally opposed elastic lips extending from said lateral walls of said slot inwardly of said groove for forming a ratchet relationship with said laterally opposed recesses of said lower part of said small bar.

10. A binding apparatus according to claim 1, said small bar having a lower part with lateral vertical sides having a pair of laterally opposed recesses, said slot of said longitudinal groove having a pair of lateral walls with a pair of laterally opposed projections cooperating with said pair of laterally opposed recesses of said small bar for maintaining said small bar, either in an extended position in relation to the base, or in an engaged position in said longitudinal groove of said base.

11. A binding apparatus according to claim 1, said small bar having a lower part with lateral vertical sides having a pair of laterally opposed projections, said slot of said longitudinal groove having a pair of lateral walls with a pair of laterally opposed recesses cooperating with said pair of laterally opposed projections of said small bar for maintaining said small bar, either in an extended position in relation to the base, or in an engaged position in said longitudinal groove of said base.

12. A binding apparatus according to claim 1, said base having a front, said small bar having a lower part and a wider upper part, said lower part and said upper part having a junction which is inclined from top to bottom towards said front of said base, said slot and said channel of said longitudinal groove having a junction having an incline equal to said junction of said lower part and said upper part of said small bar.

13. A binding apparatus according to claim 1, said small bar and said longitudinal groove having a shape, in plan view, which converges from front to rear.

14. A binding apparatus according to claim 1, said small bar having a front surface, a lower rear surface and a bevelled lower surface extending from said lower rear surface to said front surface, said bevelled surface being positioned between said hole for said hidden screw and said front surface of said small bar, said base having a front lower bevelled surface which coincides with bevelled surface of said small bar.

15. A binding apparatus according to claim said longitudinal groove having a rear end, said small bar having a rear end and a length slightly less than said longitudinal groove so that a slight gap exists between said rear end of said small bar and said rear end of said longitudinal groove when said small bar is completely positioned within said longitudinal groove of said base.

16. A ski binding apparatus comprising:

a base for engagement with the upper surface of a ski;

means for attaching said base to the ski;

said base having a lower surface and an end surface, said base further having a longitudinally extending groove which opens in said lower surface and said end surface; and a retention element for engagement within said longitudinally extending groove of said base for retaining a fastener outside of said base prior to assembly of said base upon the ski, and for retaining said base upon the ski after assembly of said base upon the ski, said retention element comprising means for facilitating the fastening of said fastener to the ski;

wherein said means for attaching said base to the ski is spaced from said retention element.

17. The ski binding apparatus of claim 16, said groove of said base having an enlarged upper portion connected with a smaller lower portion, said lower portion opening to said lower surface of said base.

18. The ski binding apparatus of claim 17, said retention element having an enlarged upper part connected to a smaller lower part, said groove of said base and said retention element having generally equal transverse cross-sections.

19. The ski binding apparatus of claim 18, said upper portion of said groove and said upper part of said retention element having transverse cross-sections in the form of a trapezoid.

20. The ski binding apparatus of claim 18, said groove and said retention element having respective inner ends, said upper portion of said groove and said upper part of said retention element having respective inner end portions which extend beyond respective inner end portions of said lower portion of said groove and said lower part of said retention element.

21. The ski binding apparatus of claim 16, said retention element having a lower surface with a locating pin extending therefrom for introduction into a pilot hole provided in the ski.

22. The ski binding apparatus of claim 16, said groove of said base and said retention element having complementary means for securing said retention element in an extended position, in which said retention element extends beyond said base in a transport position prior to assembly of said binding apparatus onto the ski.

23. The ski binding apparatus of claim 16, said groove of said base and said retention element having respective lengths that are generally equal, whereby said retention element is insertable within said groove such that respective outer surfaces of said base and said retention element are generally flush after assembly of said binding apparatus onto the ski.

24. The ski binding apparatus of claim 16, said groove of said base has a length that is slightly greater than a length of said retention element to permit a slight gap in an assembly position of said binding apparatus on the ski.

25. The ski binding apparatus of claim 16, said lower surface of said base comprises a forward lower surface and a rearward lower surface, said forward lower surface and said rearward lower surface being connected at a transverse edge, whereby said forward lower surface and said rearward lower surface form an angle at said transverse edge of slightly more than 180°.

26. A retention assembly for securing a ski binding upon a ski comprising:

(a) a fastener; and (b) a retention element for engagement within a longitudinally extending groove of a base of a ski binding, said retention element having a hole within which said fastener is positioned and retained by said retention element outside of the base prior to assembly of the base upon the ski, said retention element comprising means for retaining the base upon the ski after assembly of the base upon the ski and for facilitating the fastening of said fastener to the ski, said retention element having a lower surface with a locating pin extending therefrom for introduction into a pilot hole provided in the ski.

27. The retention assembly of claim 26, said retention element having a lower part and an enlarged upper part.

28. A method of assembling a ski binding to a ski, said ski binding having a base having a longitudinally extending groove opening in a lower surface and an end surface of said base, a retention element retaining a threaded fastener therein, said retention element extending from said end surface, said method comprising the steps of:

(a) placing said ski binding, having said retention element extending from said end surface, upon said ski at a first predetermined location on said ski;

(b) screwing said threaded fastener into said ski, thereby securing said threaded fastener to the ski;

(c) displacing said ski binding longitudinally toward said retention element for receiving said retention element within said longitudinally extending groove;

(d) stopping longitudinal displacement of said ski binding at a second predetermined location with said retention element being retained in said longitudinally extending groove to thereby fasten a first portion of said ski binding onto said ski; and (e) fastening a second portion of said ski binding onto said ski.

29. The method of claim 28, further comprising the step of providing a hole in said ski for receiving said threaded fastener, whereby said first predetermined location at which said ski binding is placed is determined such that said threaded fastener and said hole are substantially vertically aligned.

30. The method of claim 28, said step of fastening a second portion of said ski binding onto said ski comprising screwing a plurality of additional threaded fasteners through said base and into said ski.

31. The method of claim 30, further comprising the step of providing a plurality of holes in said ski for receiving respective ones of said additional threaded fasteners, whereby said second predetermined location at which longitudinal displacement of said ski binding is stopped is determined such that said additional threaded fasteners and their respective holes are substantially vertically aligned.

32. The method of claim 28, said step of placing said ski binding upon said ski at a first predetermined location on said ski comprising locating a locating pin, extending from a lower surface of said retention element into a pilot hole in the ski.

33. A ski binding apparatus comprising:

a base for engagement with the upper surface of a ski, said base having a lower surface and an end surface, said base further having a longitudinally extending groove which opens in said lower surface and said end surface;

at least one attachment device for attaching said base to the ski; and a retention device engaged with said longitudinally extending groove of said base for movement of said base from a mounting position, in which a portion of said retention device is maintained, by means of engagement of another portion of said retention device with said base, outside of said groove to a mounted position, in which said portion of said retention device is maintained, by means of engagement of at least said portion of said retention device with said base, within said groove, wherein said attachment device for attaching said base to the ski is spaced from said retention device.

34. A binding apparatus according to claim 33, wherein said base includes a lowermost surface and said retention device includes a lowermost surface, said lowermost surface of said base and said lowermost surface of said retention device being generally coextensive for engagement of said lowermost surface of said base and said lowermost surface of said retention device with the upper surface of the ski both in said mounting position of said base an in said mounted position of said base.

35. A binding apparatus according to claim 33, wherein the binding is a front binding, wherein said end surface of said base is a forward end surface, and wherein said portion of said retention device, in said mounting position, projects longitudinally forwardly from said end surface.

36. A binding apparatus according to claim 33, wherein said retention device comprises a hole and a screw maintained in said hole of said retention device outside of said groove in said mounting position.

37. A binding apparatus according to claim 36, further comprising two holes in said base, wherein said at least one attachment device for attaching said base to the ski comprises two further screws and wherein, in said mounting position, said two further screws are maintained by said base in said two holes in said base.

38. A binding apparatus according to claim 33, wherein said at least one attachment device for attaching said base to the ski comprises two screws.

39. A binding apparatus according to claim 33, wherein said base comprises a lower surface for engagement with the upper surface of the ski in said mounted position, wherein said base further comprises at least one hole extending to said lower surface, and wherein said at least one attachment device comprises at least one screw maintained in said hole.

40. A binding apparatus for a ski comprising:

a body, said carrying a jaw for retention of a boot, said body having a lower portion;

a base affixed to said lower portion of said body;

at least one screw for mounting said base to the ski, said base having at least one hole for receiving said at least one screw for mounting said binding to the ski, said base having a lower surface and a frontal surface, said base further comprising a longitudinal groove formed in said lower surface, said longitudinal groove extending to and opening into said lower surface and said frontal surface of said base, said longitudinal groove having a slot which extends to said lower surface and a channel being larger than said slot;

a retention device slidably mounted and partially engagable within said longitudinal groove in a transport position of said binding apparatus; and a further screw for mounting said retention device to the ski, said retention device and said groove having generally complementary transverse cross-sections for preventing substantial movement of said retention device in a direction perpendicular to said lower surface of said base, said retention device further comprising a hole within which said further screw is maintained, exteriorly of said base, in said transport position of said binding apparatus, said further screw comprising a hidden screw, being hidden within said groove in a mounted position of said binding apparatus upon the ski, said retention device having a lower surface, said lower surface of said base and said lower surface of said retention device being generally co-extensive and positioned relative to each other for engagement with an upper ski surface in said transport position and in said mounted position of said binding apparatus, said at least one screw being spaced from said retention device.

41. A ski binding apparatus comprising:

(a) a base for engagement with the upper surface of a ski, said base having a lower surface and an end surface, said base further having a longitudinally extending groove which opens in said lower surface and said end surface;

(b) means for mounting said base to the ski; and (c) a retention device longitudinally slidably engagable with said longitudinally extending groove of said base, said retention device comprising:

(i) a screw having a head formed for engagement with a screwdriver; and (ii) means for (1) maintaining said screw longitudinally spaced from said longitudinally extending groove and longitudinally spaced from said end surface of said base in a transport and mounting position of said binding apparatus for facilitating unrestricted access to said head of said screw for the screwdriver; and (2) maintaining said screw hidden within said longitudinally extending groove in a mounted position of said binding apparatus;

wherein said means for mounting said base to the ski is spaced from said retention device.

* * * * *